US006764719B2

(12) United States Patent
Russell et al.

(10) Patent No.: US 6,764,719 B2
(45) Date of Patent: Jul. 20, 2004

(54) PORTABLE RADIATION CURE DEVICE

(75) Inventors: Scott T. Russell, Woodbury, MN (US); Kelvin D. Sundeen, Eagan, MN (US); Keith E. Olson, Apple Valley, MN (US); Bryan M. Anderson, St. Paul, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/954,716

(22) Filed: Sep. 18, 2001

(65) Prior Publication Data

US 2002/0073921 A1 Jun. 20, 2002

Related U.S. Application Data

(60) Provisional application No. 60/233,116, filed on Sep. 18, 2000.

(51) Int. Cl.[7] ..... B05D 3/06

(52) U.S. Cl. ..... 427/393.5; 427/508; 219/202; 250/504 R; 250/493.1

(58) Field of Search ..... 250/504 R, 493.1; 427/393.5, 508; 219/202

(56) References Cited

U.S. PATENT DOCUMENTS

| | | | | |
|---|---|---|---|---|
| 2,057,776 A | | 10/1936 | Groven | 219/45 |
| 4,200,085 A | | 4/1980 | Buehl | 126/9 B |
| 4,241,255 A | * | 12/1980 | Sugiyama et al. | 250/504 R |
| 4,309,452 A | | 1/1982 | Sachs | |
| 4,999,216 A | * | 3/1991 | Gaske et al. | 427/519 |
| 6,096,383 A | | 8/2000 | Berg et al. | 427/493 |
| 6,207,118 B1 | | 3/2001 | Gaven et al. | |
| 2002/0175299 A1 | | 11/2002 | Kanie et al. | |

FOREIGN PATENT DOCUMENTS

| | | |
|---|---|---|
| JP | 6-134381 | 5/1994 |
| WO | WO 01/21321 | 3/2001 |

OTHER PUBLICATIONS

Multi–Clean Brochure, dated Jul. 1999.

Multi–Clean® Article (Jul. 1999), 4 pgs.

* cited by examiner

*Primary Examiner*—Nikita Wells
(74) *Attorney, Agent, or Firm*—IPLM Group, P.A.

(57) ABSTRACT

A radiation cure device (10) has a removable light housing (25). The cure device (10) utilizes a fixed output power supply (55), a shutter mechanism (30) and is easily maneuverable because of its lighter weight. The light housing (20) is laterally offset and is adjustable in a lateral direction.

15 Claims, 11 Drawing Sheets

PORTABLE RADIATION CURE DEVICE

This application claims the benefit of U.S. provisional application 60/233,116 filed Sep. 18, 2000.

BACKGROUND OF THE INVENTION

1. Field of the Invention

This invention relates generally to a radiation cure device, and more specifically to a portable device having increased maneuverability, a laterally moveable and removable light housing.

2. Description of the Prior Art

Recently there has been developed a new ultraviolet coating for use on floors. The ultraviolet coating will protect floors from wear. In maintaining a floor in commercial settings, the cost to maintain a floor are approximately 85 percent labor and 15 percent material. Therefore, an ultraviolet coating that would reduce the labor results in significant savings and therefore increases the popularity of the newly developed UV coating. However, the UV coating cure devices to date having typically been quite large and cumbersome. They are often 400 pounds in weight and quite large. The maneuverability of these large curing devices are poor. Further, it is difficult to take a larger device into smaller areas such as a racquetball court. Still further, it would be difficult to lift the device over the threshold of some rooms such as racquetball courts. Japanese Patent 6'134381 discloses a UV curing device that has two sets of wheels, one for the X axis and one for the Y axis. Such a device does increase the maneuverability, but does little for reducing the size, protecting the light and making the cart easily maneuverable in small spaces.

The amount of curing that is done by the ultraviolet light is very dependent upon the voltage to which the cured device is connected. An operator will typically expect 120 volts from the outlet. However, due to problems that may arise from the transmission of power by the power companies, the voltage may be less than 120 volts. Other common reasons for having less than the anticipated voltage include long power runs, long extension cords and small gauge wires. Therefore, it is quite possible that an operator may attempt to cure an entire floor at 110 volts and then discover that the coating has not been cured due to a lack of power to the light source. It would then be necessary to redo the entire floor, resulting in a considerable waste of time. If the operator had known about the low voltage to begin with, the operator could have compensated for this when the first pass over the floor was made. It is, of course, understood that in other countries, the voltage may vary from 120 volts, but the same problem exists as to knowing the voltage that is being supplied.

In addition, it is often necessary to cure a floor that is under a protrusion. The protrusion could be a heating duct or other similar structure. The structure would be several inches off of the floor and would run along the length of a wall. Previously, in order to cure underneath such an obstacle, it was necessary to go perpendicular to the wall and cure only the width of the light housing. Then the curing device is moved over the width of the light housing and then moved in again. This was necessary because the light housing and the device would not fit under the obstruction if the curing device was run parallel to the obstruction. This takes a substantial amount of time to move into and out of each position, rather than running parallel along the length of the obstruction.

The present invention addresses the problems associated with the prior art devices and provides for an improved radiation-curing device. As used in this application, radiation may refer to ultraviolet, infrared or visible light. The type of radiation that is used would be dependent upon the coating and what radiation is necessary to cure the coating. The radiation radiates photo energy of any wavelength or frequency which causes curing or crosslinking or which catalyzes free radical polymerization of the applied photoreceptive materials to create the desired coating. The present invention is not limited to any particular coating or to any band of photoenergy other than the material be capable of being cured from a liquid to a solid state upon exposure of photoradiation after the coating has been applied to a floor surface.

SUMMARY OF THE INVENTION

In one embodiment, the invention is an apparatus for curing a photocurable material applied to a floor surface. The apparatus includes a wheeled frame, a light housing releasably connected with the frame, a power supply operatively connected to the frame and a source for curing light mounted in the light housing. A first connector is operatively connected to the power supply and a second, mating connector is operatively connected to the source of curing light, wherein the first and second connectors are releasably connected to each other. A releasable connection between the housing and the frame consisting essentially of one mechanical connection, the mechanical connection consisting essentially of a first mounting mechanism operatively connected to the light housing and a second mounting mechanism operatively connected to the frame, and in mating connection to the first mounting mechanism, wherein the light housing is releasably connected to the frame.

In another embodiment, the invention is an apparatus for curing a photocurable material applied to a floor surface. The apparatus includes a wheeled frame, a light housing operatively connected to the frame and a fixed output power supply. A source of curing light is mounted in the light housing and the light housing has a top and the top has a maximum height of 7 inches from the floor, wherein the apparatus is transportable and easily maneuverable in areas with limited access.

In another embodiment, the invention is an apparatus for curing a photocurable material applied to a floor surface having a wheeled frame, a light housing releasably connected to the frame and a power supply operatively connected to the frame. A source of curing light is mounted in the light housing. A first mounting mechanism is operatively connected to the light housing and a second mounting mechanism is operatively connected to the frame, wherein the light housing is releasably connected to the frame. One of the first and second mounting mechanisms have first and second positions, whereby the light housing is connectable to the frame at first and second lateral positions.

In another embodiment, the invention is an apparatus for curing a photocurable material applied to a floor surface. The apparatus includes a wheeled frame, a light housing operatively connected to the frame and a power supply operatively connected to the frame. A source of curing light is mounted in the light housing and the light housing is sized and configured to extend laterally at least one inch from any other portions of the apparatus, wherein the apparatus is movable parallel to and underneath an overhang.

In another embodiment, the invention is an apparatus for curing a photocurable material applied to a floor surface. The apparatus includes a wheeled frame, a light housing releasably connected to the frame and a fixed output power supply. A source of curing light is mounted in the light housing. A first connector is operatively connected to the power supply and a second, mating connector is operatively connected to the source of curing light, wherein the first and second connectors are releasably connected to each other. There is a releasable connection between the housing and the frame consisting essentially of a first mounting mechanism operatively connected to the light housing and a second mounting mechanism operatively connected to the frame, wherein the light housing is releasably connected to the frame and in mating connection to the first mounting mechanism. The light housing has a height of 7 inches or less from the floor and the apparatus has a weight of 100 pounds or less, wherein the apparatus is transportable and easily maneuverable in areas of limited access. One of the first and second mounting mechanism have first and second positions whereby the housing is connectable to the frame at first and second lateral positions. The light housing is sized and configured to extend laterally at least 1 inch from any other portion of the apparatus, wherein the apparatus is movable parallel to and underneath an overhang.

In another embodiment, the invention is a method of curing a photocurable material applied to a floor surface. The method includes applying a photocurable material to a floor, a wall having an obstruction extending out over the floor at least 1 inch in width. The apparatus is positioned for curing the photocurable material proximate the obstruction. The apparatus has a wheeled frame, a light housing operatively connected to the frame and a power supply operatively connected to the frame. A source of curing light is mounted in the light housing and the light housing is sized and configured to extend, laterally, at least 1 inch from any other portion of the apparatus. The apparatus is moved parallel to and underneath the obstruction.

In another embodiment, the invention is a method of replacing a light source in an apparatus for curing a photocurable material, the apparatus having a wheeled frame, a light housing releasably connected to the frame, a power supply operatively connected to the frame and a source of curing light mounted in the light housing. A first connector is operatively connected to the power supply and a second, mating connector is operatively connected to the source of curing light, wherein the first and second connectors are releasably connected to each other. A first mounting mechanism is operatively connected to the light housing and a second mounting mechanism is operatively connected to the frame, wherein the light housing is releasably connected to the frame. The method includes operating the apparatus, whereby the source of curing light becomes hot and then bums out. Prior to the light cooling, a first light housing is disconnected from the frame. The first light housing is replaced with a second light housing having a second source of light, whereby the apparatus may then be used without delay.

In another embodiment, the invention is a method of curing a photocurable material applied to a floor surface. The method includes applying a photocurable material to a floor. Then, an apparatus is positioned for curing the photocurable material. The apparatus has a wheeled frame, a light housing operatively connected to the frame and a power supply operatively connected to the frame. A source of curing light is mounted in the light housing. Then, the voltage being supplied to the apparatus is measured, whereby the voltage being supplied is used to determine a speed sufficient to move the apparatus to cure the photocurable material.

In another embodiment, the invention is a method of curing a photocurable material applied to a floor surface. The method includes applying a photocurable material to a floor. Then, an apparatus is positioned for curing the photocurable material. The apparatus has a wheeled frame, a light housing operatively connected to the frame and a power supply operatively connected to the frame. A source of curing light is mounted in the light housing. Then, the voltage being supplied to the apparatus is measured, whereby the voltage being supplied is used to determine if sufficient power is available to cure the photocurable material.

DETAILED DESCRIPTION OF THE PREFERRED EMBODIMENT

Figure 4:
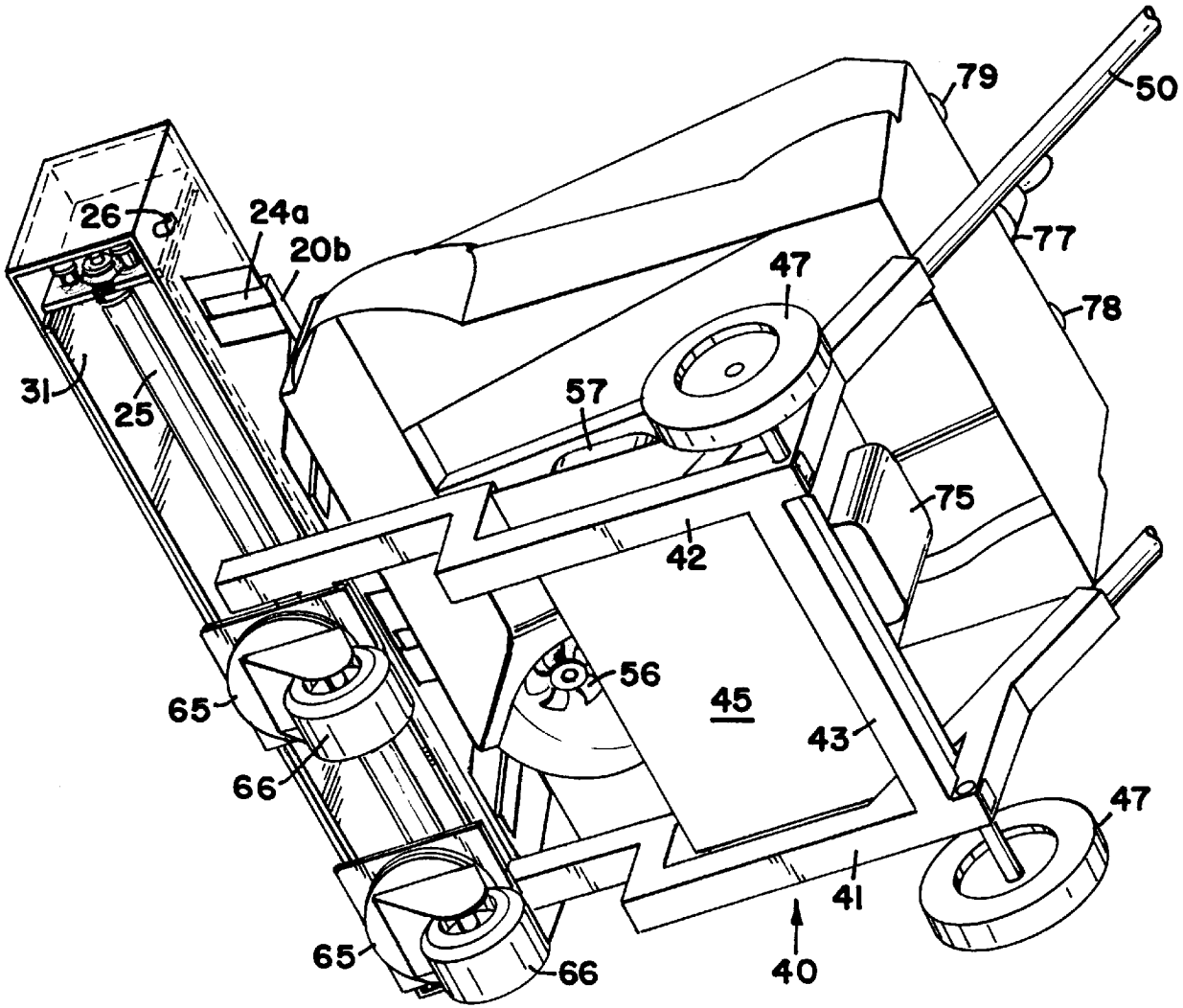
FIG. 4 is a perspective view of the radiation curing device of FIG. 1 viewed generally from underneath.
Figure 7:
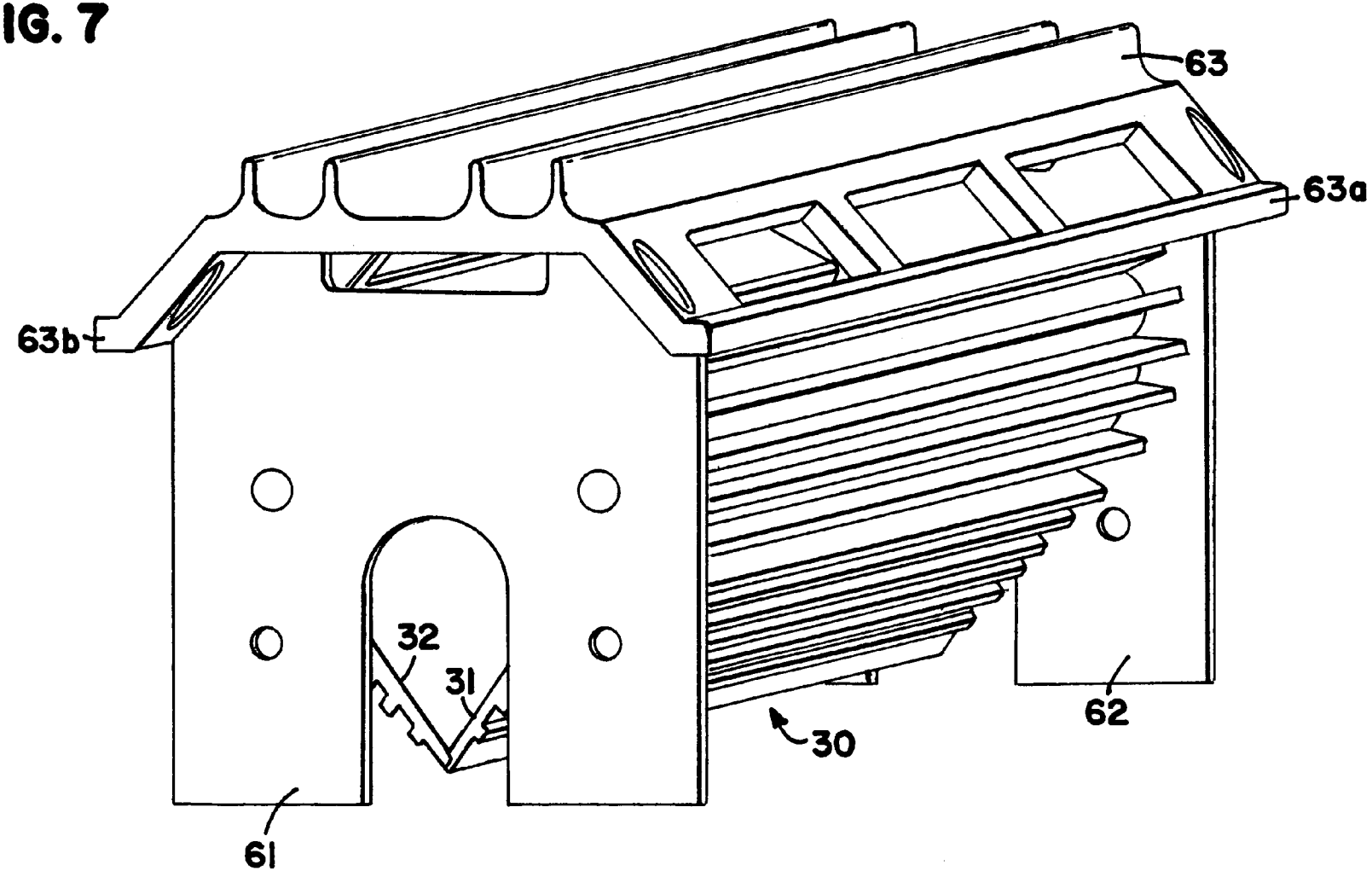
FIG. 7 is a perspective view of the light and shutter assembly positioned in the light housing shown in FIG. 1, viewed generally from above.
Figure 8:
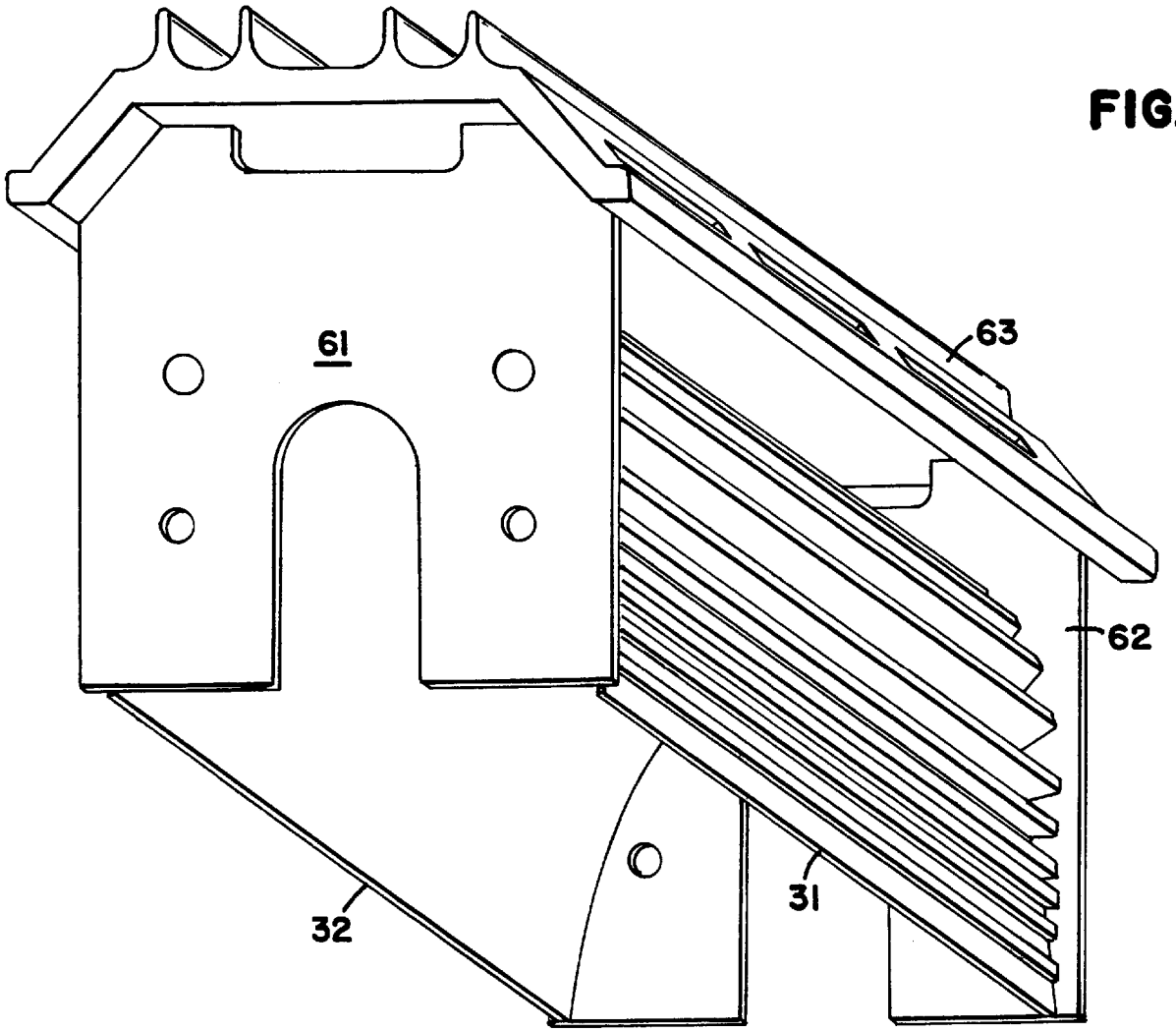
FIG. 8 is a perspective view of the light and shutter assembly positioned in the light housing shown in FIG. 1, viewed generally from below.

Referring to the drawings, wherein like numerals represent like parts throughout the several views, there is generally disclosed at 10 a radiation cure device. The radiation cure device 10 includes a removable light housing 20. The light housing 20 is in the shape of a rectangular box having an open bottom. The light housing 20 has a top 20*a* which has a slight protrusion 20*b* formed therein. The light housing 20 is mounted, as will be described more fully hereafter, so that the bottom 20*c* is approximately ½ inch from the floor. The sides 20*d* have a height of approximately 5 inches, thereby making the top 20*a* 5½ inches from the floor. The protuberance 20*b* has a height of approximately 1½ inches and is sized and configured for the mounting, by means well known in the art, two housing fans 60. The fans 60 provide cooling for the curing light 25. Inside of the box is mounted a curing light 25. The curing light 25 is typically an ultraviolet curing light, as is well known in the art. The curing light 25 is mounted in a shutter mechanism 30. The shutter includes a first panel 31 and a second panel 32. Referring now especially to FIGS. 7 and 8, the shutter mechanism 30 is shown in more detail. The panels 31, 32 are pivotable to move from a closed position to an open position. A button 33 is depressible by means of a trigger 34 which is mounted to a handle 50. The trigger 34 is connected by a cable (not shown) which has an end which is proximate the button 33. Then, by depressing the trigger 34, the end of the cable extends and depresses the button 33, thereby moving a suitable mechanism inside of the housing 20 to move the first and second panels 31, 32 to the open position. The shutter 30 allows the light 25 to be left on at all times without the use of a variable power supply, thereby saving substantially in weight and ease of design. FIG. 7 shows the shutter assembly in a closed position and FIG. 8 shows the shutter assembly in an open position. The curing light 25 is mounted inside of the shutter assembly, by means well known in the art, and as shown in FIG. 4. The panels 30, 31 are mounted between two end panels 61, 62. A top member 63 is operatively connected to and mounted between the end panels 61, 62. This provides the structure for the mounting of the panels 31, 32. The top 63 has a plurality of fins and openings to assist in dissipating heat that arises from the light 25. The top 63 has flanges 63*a*, 63*b* formed therein. The shutter and light assembly, as shown in FIG. 7, is mounted in the housing 20 by the flanges 63*a* being received by elongate slots (not shown) inside of the light housing 20. The shutter 30 is one similar to that used by Fusion Aetek UV Systems for other industrial applications, but uses a mechanical system to actuate the shutter device as opposed to an air supply which is available in other industrial applications. It is understood that any suitable mechanism may be used to operate the opening and closing of the shutter 30. Further, it is understood that other suitable shutters 30 may be utilized as shutters are known in the art, such as those shown in International Application No. PCT/US99/21584. The height of the protuberance 20*b* of light housing 20 is only 7 inches from the floor to allow the device 10 to reach into smaller, or tighter areas, such as underneath a kick board or a desk. The height of the top 20*a* of the light housing 20 is only 5½ inches from the floor, allowing for even better access under tight areas for that portion of the light housing 20. While the highest point of the light housing is only 7 inches from the floor, it is recognized that even a slightly higher light housing, while not as optimal, would still be beneficial. That is, a height of 10 inches or less would be advantageous compared to the prior art. It of course being understood that the lower the overall height of the light housing the better for reaching into tight areas. Two 3-inch openings 28 are formed in the protuberance 20*b*. Mounted underneath the openings 28, by suitable means well known in the art, are two fans 29.

The housing 20 has two amphenol connectors 22 which are suitably connected to the light 25 to provide power to the light 25. The connectors 22 may be screw connectors or quick disconnect connectors. The connectors 22 have a female component 22*a* that is secured to the housing 20 and a male component 22*b* that is attached to the power wire 64 from the power supply 55. This arrangement provides for a quick and easy disconnect to enable the light housing 20 to be disconnected from the frame 40.

Figure 5:
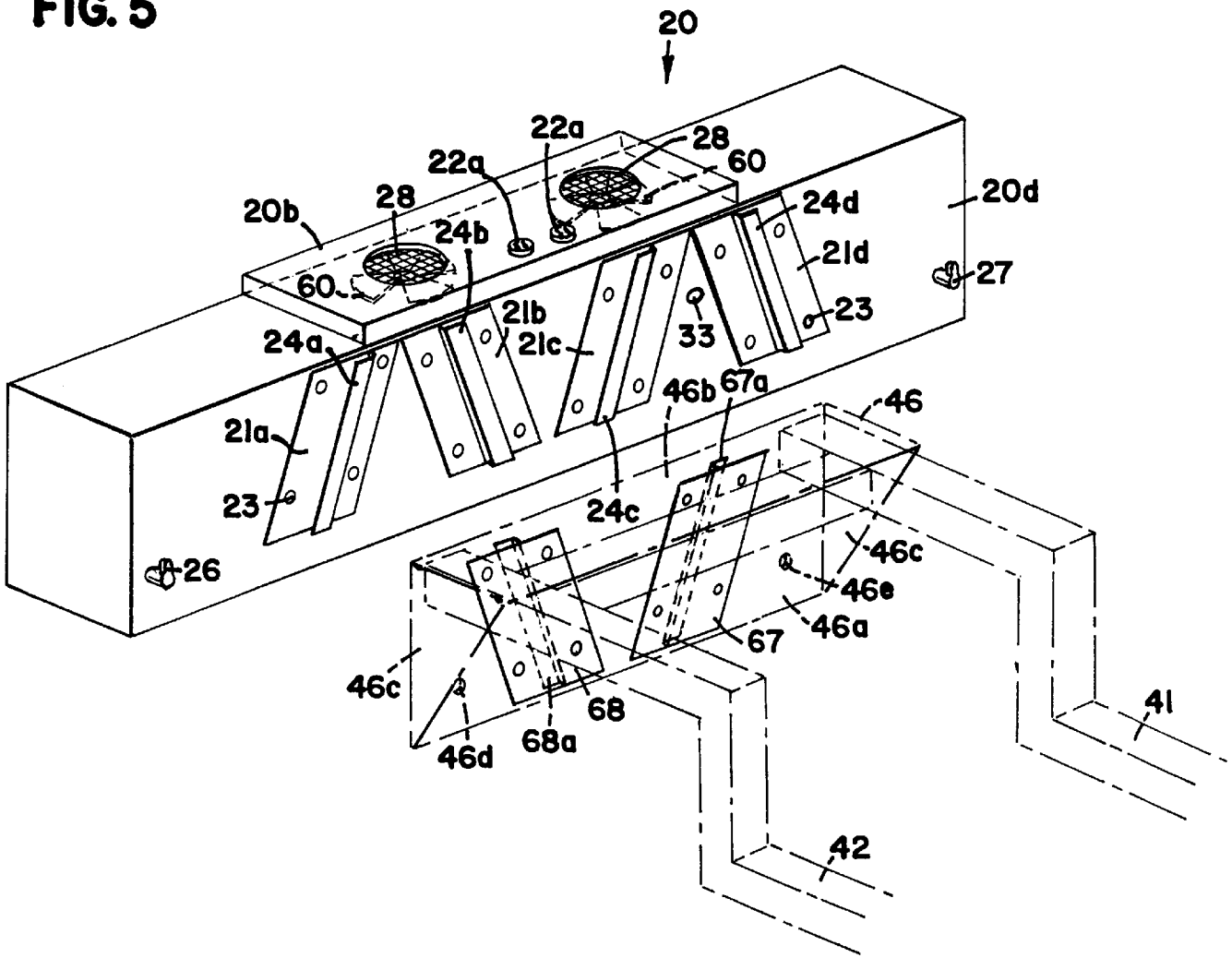
FIG. 5 is a perspective view of the light housing radiation cure device of FIG. 1 and the mounting mechanism on the shroud.

The housing 20 may easily be removed in a short period of time, less than one minute. Further, the light housing 20 can be removed without the use of tools. This is accomplished by means having a first mounting mechanism on the light housing 20 and a second mounting mechanism carried by the frame 40. The first mounting mechanism comprises four plates 21*a*–21*d* mounted on the back wall 20*e* by suitable means such as bolts 23. Angled protrusions 24*a*–24*d* are mounted to the plates 21*a*–21*d* by suitable means such as welding. Two mounting studs 26, 27 are also secured to the back wall 20*e* of the housing 20. As will be described more fully hereafter, the angled protrusions 24*b*, 24*c* are utilized in mounting the housing 20 in a central position. Angled protrusion 24*d* and mounting stud 27 are utilized when mounting the housing in a position laterally to the left, as viewed in FIG. 5. Angled protrusion 24*a* and mounting stud 26 are utilized in mounting the housing 20 to a laterally opposite position to the right, as viewed in FIG. 5.

Figure 11:
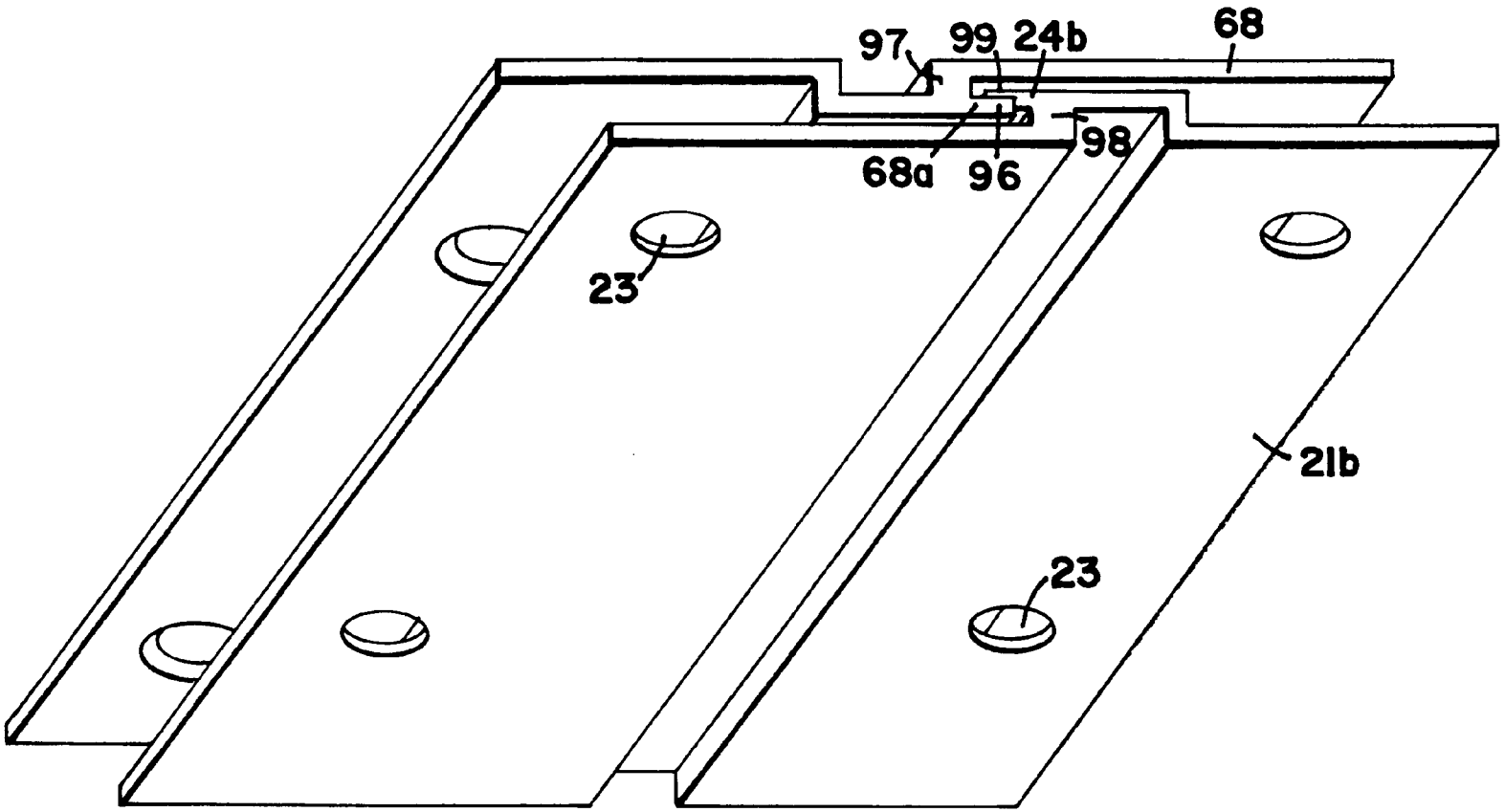
FIG. 11 is an enlarged perspective view of the plates on the light housing and the frame.

An enlarged view of a portion of the first mounting mechanism and second mounting mechanism is shown in FIG. 11. Here, the interlocking mechanism for connecting the housing 20 to the frame 40 without fasteners is shown in more detail. The angled protrusion 24*b* has a first segment 98 which is perpendicular to the plate 21*b*. A second segment 99 is operatively connected to and preferably integral with the first segment 98. The second segment 99 is perpendicular to the first segment 98. The second segment 99 is parallel to and spaced from the plate 21*b*. Similarly, the angled protrusion 68*a* has a first segment 97 that is perpendicular to the plate 68 and a second segment 96 which is perpendicular to the first segment 97. The second segment 96 is parallel to and spaced from the plate 68. The second segment 99 and plate 21*b* forms a slot into which the second segment 96 is positioned. Further, the second segment 96 and plate 68 forms a slot in which the second segment 99 is positioned. This sliding, interlocking connection provides for an interlocking of the light housing 20 and frame 20 which consists of a single releasable connection consisting essentially of the first mounting mechanism and second mounting mechanism for holding the light housing 20 in place. No further assembly, such as wing nuts, etc., are utilized.

The frame 40 includes a right member 41 connected to a left member 42 by a rear member 43. A front member 44 also connects the right side 41 to the left side 42. The right side 41 and left side 42 have an angle proximate the front to mount two casters 65. Two wheels 66 are mounted in the casters 65. The casters 65 rotate to provide for maneuverability for the device 10. A bottom 45 is attached to the frame 40 to form a platform for the power supply 55. Attached to the front of the frame 40 is a second attachment plate 46. The attachment plate 46 has been removed from some Figures to better show other features of this invention. The second attachment plate has a front member 46*a* operatively connected to a top member 46*b*. Two triangular shaped side members 46*c* are operatively connected to the top member 46*b* and front member 46*a*. The members 46*a*–46*c* are connected by means well known in the art, such as welding. Two support openings 46*d*, 46*e* are formed in the front member 46*a*. As will be described later, the support openings 46*d*, 46*e* are sized and configured to receive the mounting studs 26, 27. The attachment plate 46 is secured to the frame 40 by suitable means such as welding. The top member 46*b* rests on the front member 44 and the sides 46*c* are positioned proximate the right side 41 and left side 42. Two plates 67, 68 are secured to the front member 46*a* by suitable means such as bolts. Angled protrusions 68*a*, 67*a* are connected to the plate 67, 68 by suitable means such as welding. The protrusions 67*a*, 68*a* mate with the angled protrusions 24*b*, 24*c* to allow for a releasable connection between the light housing 20 and the frame 40. It can be seen that the angled protrusion 24*b* mates with the angled protrusion 68*a* and protrusion 24*c* mates with angled protrusion 67*a*. This creates for a simple and easy connection and allows for the light housing to be removed with no tools and also easily in less than one minute. It is only necessary to disconnect the wiring connectors from the connectors 22 and lift off the light housing to remove the light housing 20. The housing 20 is simply positioned above the angled protrusions 68*a*, 67*a*, with the protrusions 24*b*, 24*c* adjacent. Then the housing 20 is lowered and the angled protrusions 68*a*, 67*a* guide the housing 20 into position. It can be seen that each of the angled protrusions 24*a*–24*d* and 67*a*, 68*a* are L-shaped and are set at the same angle, with respect to their respective plates, as the protrusion to which they mate. The protrusions 68*a*, 67*a* form a V to receive the angled protrusions 24*b*, 24*c*. The V formed by the protrusions 67*a*, 68*a* will limit the downward travel of the housing 20. The interlocking of the second segments 96, 99, as previously described, prevent the housing 20 from moving forward. It can therefore be seen that the housing 20 is releasably connected to the frame 20 and may be done so without tools or other connections or mechanisms to hold the housing 20 firmly in place. The mounting mechanism which consists essentially of only a single mechanism for holding the housing 20 in position. That is, the single mechanism is the combination of the angled protrusions 21*a*–21*d* and 68*a*, 67*a*. There is no secondary mechanism such as wing nuts, bolts or screws, etc., necessary and the housing is therefore provided with a very easily releasable and quickly connectable mounting mechanism. The handle 50 is attached to the frame 40 by suitable means, well known in the art, such as welding. Alternately, a folding or telescoping handle could be utilized. Two wheels 47 are secured to the back of the frame 40 to allow for maneuverability of the cart 10. The rear wheels 47 are fixed.

A covering or shroud 70 is preferably made of a durable, lightweight plastic and covers the frame 40 and the components thereon.

Figure 6A:
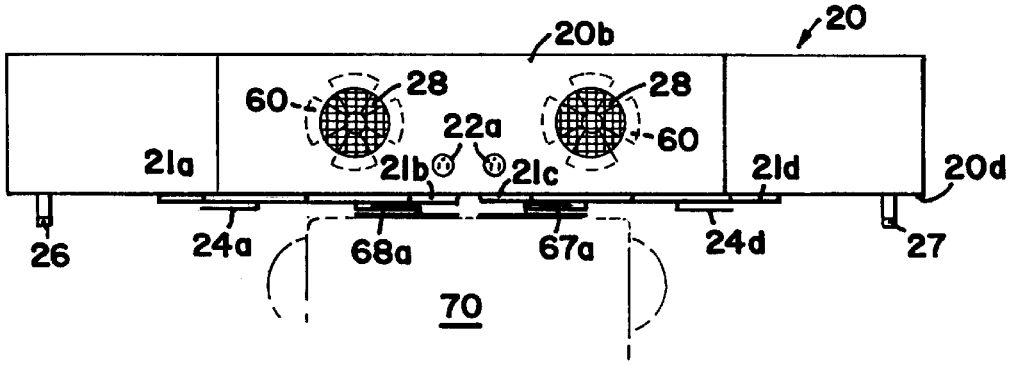
FIGS. 6A–6C are schematic representations of the light housing in various positions.
Figure 6B:
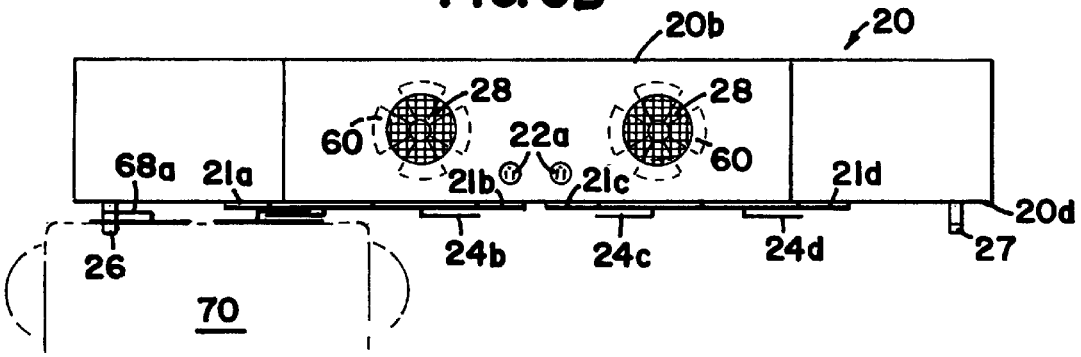
Figure 6C:
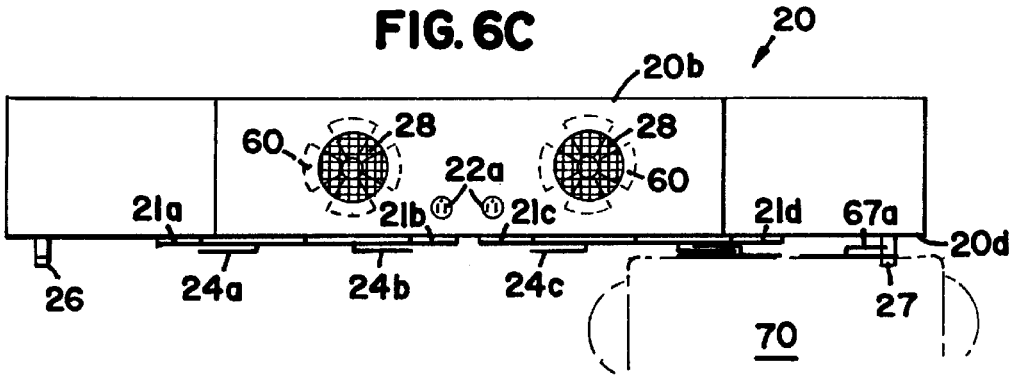

FIGS. 6*a*–6*c* are schematic representations of the light housing 20 being positioned in three different configurations. The housing 20 is 24 inches in width. The shroud 70, at its front end, has a width of 18 inches. Therefore, the housing 20 extends 3 inches laterally on both sides of the shroud 70. The shroud 70 is wider in the front than the back because of the two enlarged areas to provide for space for the caster wheels 65, 66 to rotate. At the rear, the device 10 is only 14½ inches in width. It can therefore be seen that there is a 3-inch offset that can be utilized to go underneath obstacles and parallel to the obstacles. It is not necessary to move the device 10 in and out repeatedly to cover a length of flooring underneath an obstacle. In some circumstances, a 3-inch overhang is not sufficient to get completely underneath an obstacle. Therefore, the device 10 is easily adapted to provide a further offset to the right or to the left. FIG. 6*b* shows the light housing connected with a lateral offset to the right and FIG. 6*c* shows the lateral offset to the left. For the lateral offset to the right, as shown in FIG. 6*b*, protuberance 24*a* is in mating alignment with the protuberance 67*a*. The mounting stud 26 is positioned in the supporting opening 46*d*. When in the offset position shown in FIG. 6*c*, the protuberance 24*d* is in mating relationship with the protuberance 68*a* and the mounting stud 27 is in position in the support opening 46*e*. The mounting studs 26, 27 provide support for the weight of the housing 20 as it is offset either to the right or to the left. By offsetting the housing 20, the lateral offset in either direction is increased an additional 12 inches to 15 inches. While it has been found that a lateral offset of 3 inches in the center position is advantageous for many operations, the additional lateral offset provides for additional flexibility in being able to cure hard-to-reach areas. Preferably, the lateral offset is at least 1 inch or greater, preferably at least 2 inches or greater, and more preferably at least 3 inches or greater.

Figure 10:
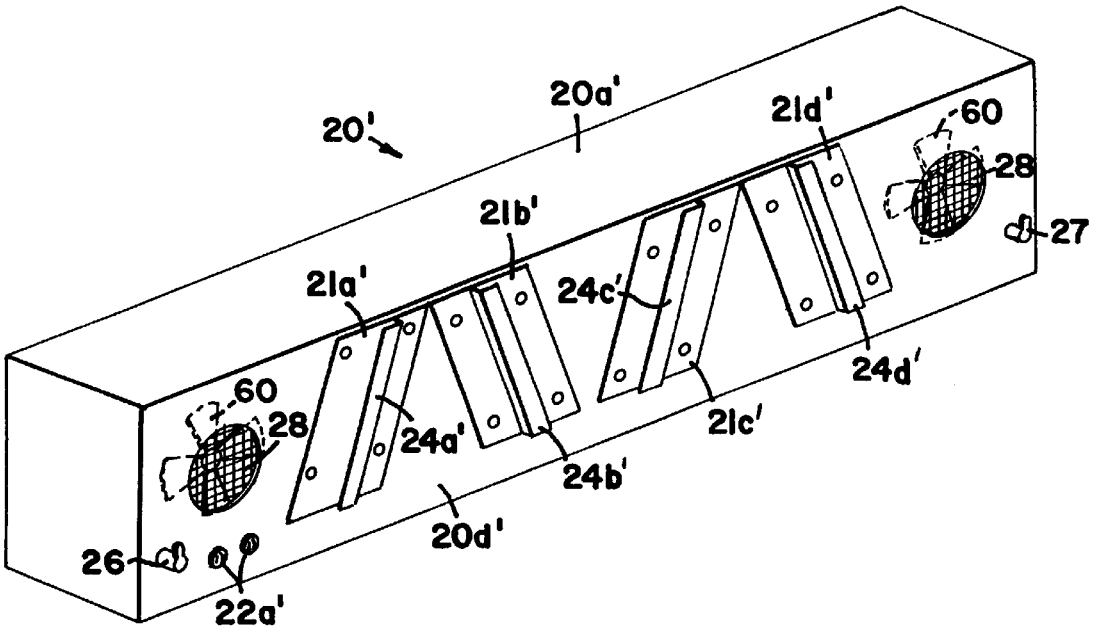
FIG. 10 is a perspective view of another embodiment of a light housing.

When not running parallel to an obstacle, the height of the housing in the center is important. If it is desired to design the device 10 so that it is more versatile for this use, a second embodiment of a light house 20' may be used. In this embodiment, the top 20*a*' is flat and there is no protuberance. Instead, the fans 60 are mounted proximate the back wall 20*d*' so as not to increase the overall height of the housing 20'. This embodiment is shown in FIG. 10. The plates 21*a*'–21*d*' are identical to the plates 21*a*–21*d*. Further, the connectors 22*a*' may be placed on the back wall 20*d*' thereby minimizing the height of the light housing 20' to allow for additional clearance when moving forward. Ultimately, when going underneath an obstacle straight in front of the device, the shroud or covering 70 will determine how far the device 10 may go under an obstacle. By placing the fans 60 and connectors 22 on the back wall 20*d*, the over height of the light housing 20 is minimized. Preferably, this height is less than 10 inches, and more preferably 7 inches or less. Further, the width of the housing, the distance from the front edge to the back edge is important. In the present embodiment, the width is 6 inches. A width of at least 4 inches or more is desired to allow for increased ability to cover hard-to-reach areas.

Figure 1:
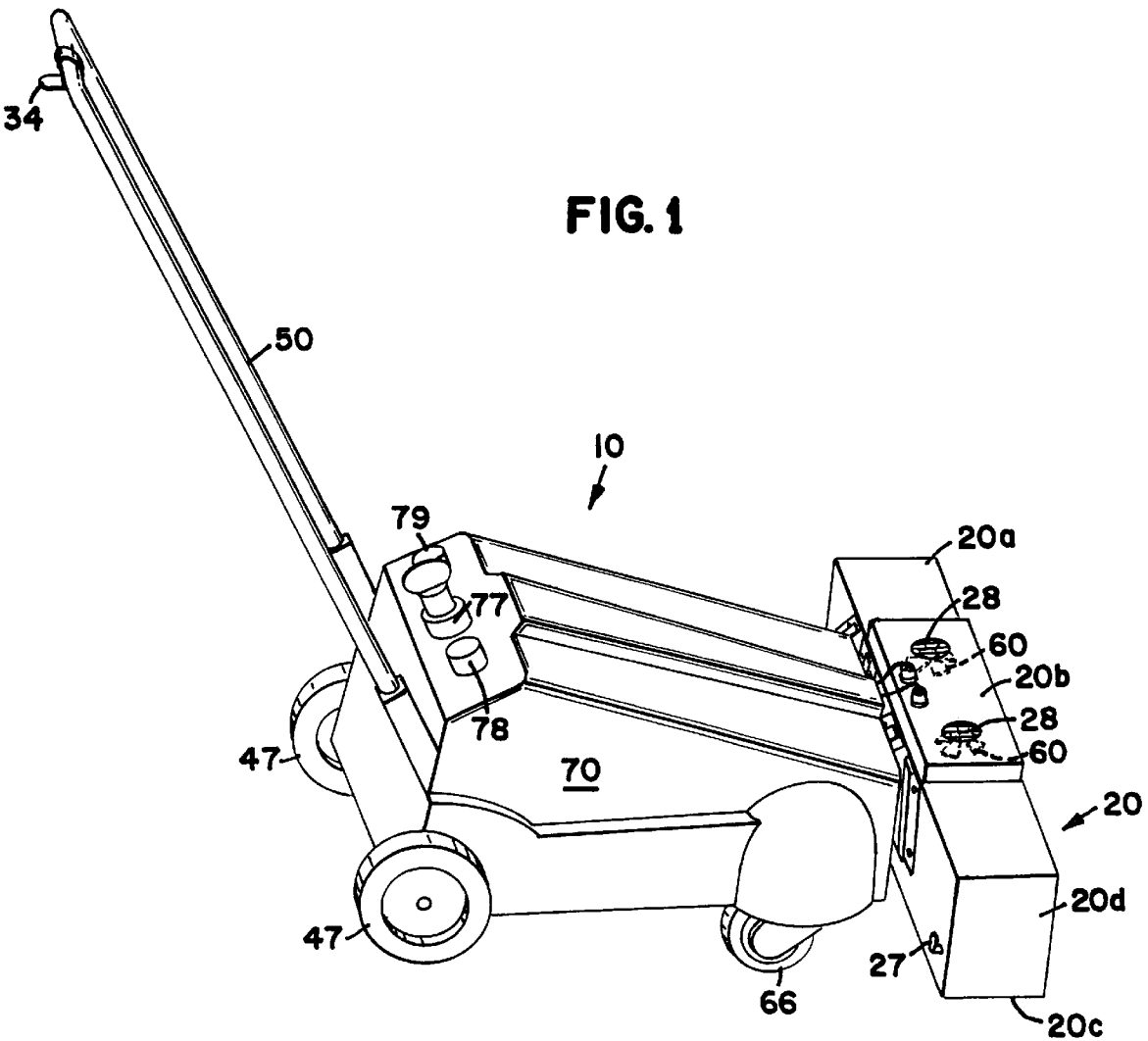
FIG. 1 is a perspective view of the radiation curing device of the present invention.
Figure 2:
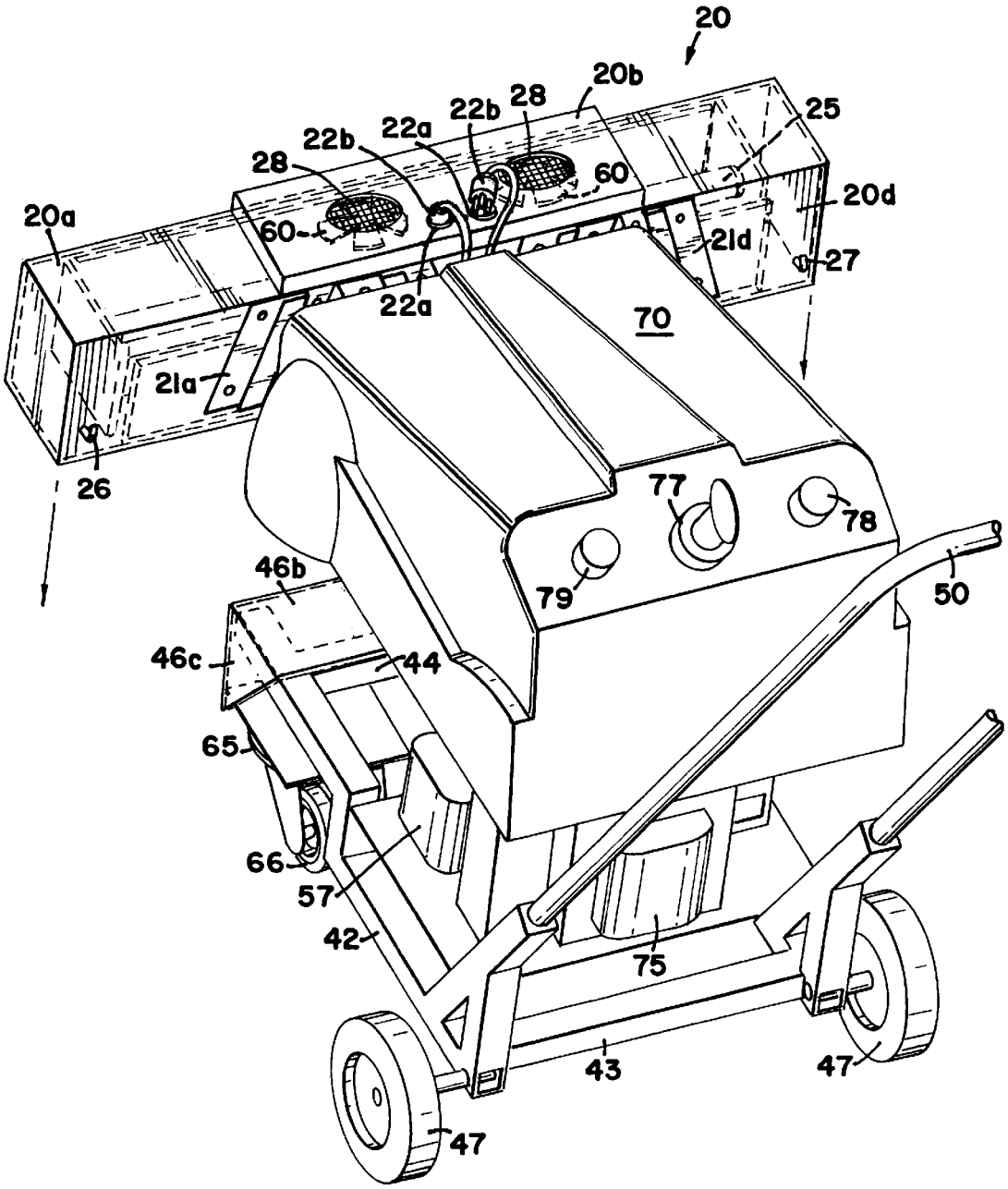
FIG. 2 is a perspective view of the radiation curing device of FIG. 1 viewed from the rear, left showing the light housing and shroud exploded away.
Figure 3:
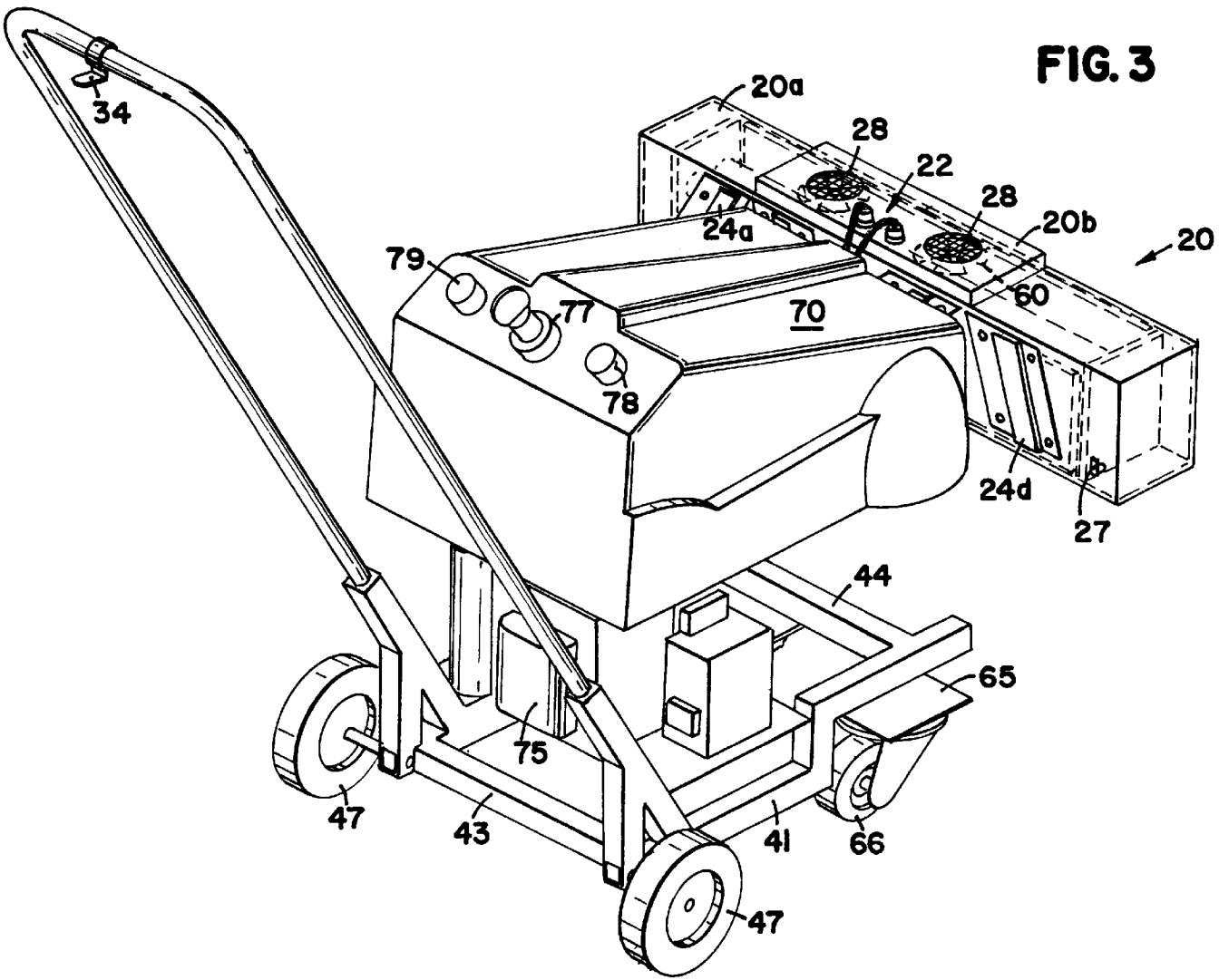
FIG. 3 is a perspective view of the radiation curing device of FIG. 1 viewed from the rear, right showing the light housing and shroud exploded away.
Figure 9:
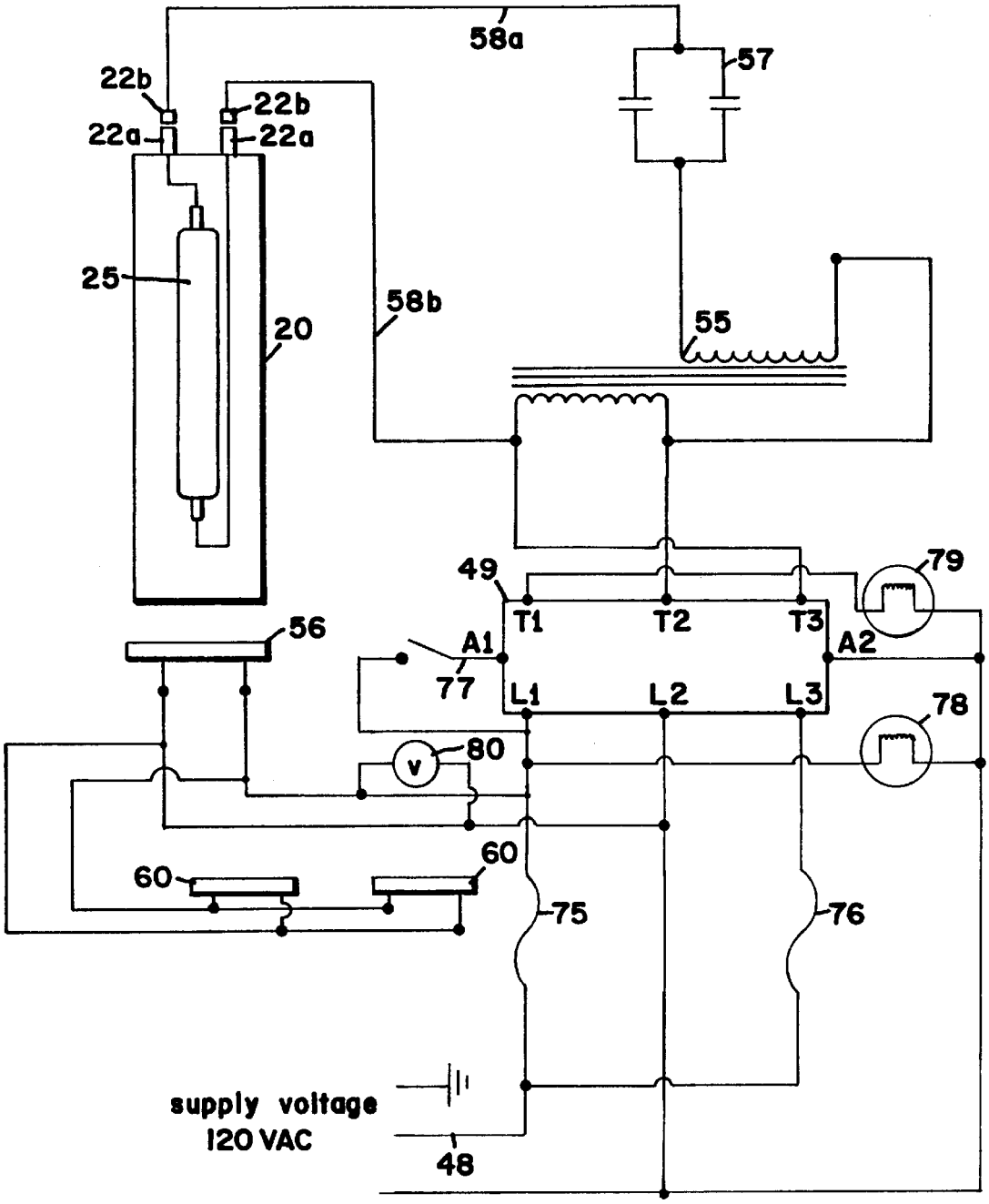
FIG. 9 is an electrical schematic of the radiation cure device shown in FIG. 1.

As shown in FIGS. 2, 3 and 9 the radiation cure device 10 includes a fixed power supply 55 which is connected to the electrical cord 48 through a connector/contactor 49. A fan 56 is mounted to the frame 40 and provides for air movement to remove heat from the radiation cure device 10. The power supply 55 is a fixed output power supply that weighs approximately 35 pounds. Prior art power supplies were typically variable power supplies that were substantially heavier. The variable power supplies allowed the amount of wattage to be adjusted. This was often used to dial down the amount of power when the light was not being used to cure the coatings. The reason for this is that the light can easily start to burn the floor in 5 to 15 seconds if it is motionless and at full power. It is also not advisable to turn the light on and off frequently as this severely shortens the life of the bulb. Therefore, the prior art devices address this problem by providing a variable power supply so that the amount of power to the light bulb could be decreased, thereby decreasing the heat. However, the present invention uses a fixed power supply so that the output is always at its maximum for curing the coating, which is desired. The use of a shutter is significant in that it allows for the light to stay on and still shut off the light and heat from the light 25 to the coating or floor and thereby preventing burning when the radiation cure device 10 is stationary.

The power supply 55 includes capacitors 57 (7 ufd and 25 ufd). A first cord 58*a* connects the capacitors 57 to a first connector 22*b* and a second cord 58*b* connects the power supply 55 to a second connector 22*b*. The first and second connectors 22*b* are releasably connected to connectors 22*a*. The connectors 22*a* are operatively connected to the light 25, wherein power is provided to the light 25.

The present invention preferably weighs less than 100 pounds and is preferred to weigh 70 pounds or less. This, in comparison to the prior art 430 pounds is a substantial reduction in weight, which greatly increases maneuverability and ease of transportation. Further, the present invention has a removable light housing 20. This allows the light housing 20, which includes the curing light 25 to easily be removed and transport it separately between jobs. Also, because of the decreased size, the cart is able to be position under any obstacles which are less than a foot off the ground with limited accessibility to items which are only 7 inches off the ground or have overhangs of that height.

A lamp power switch 77 is used to turn on the lamp 25 after the cord 48 has been plugged in to a power outlet. A power indicator 78 is mounted on the shroud 70 adjacent to the power switch 77 and is lit when the plug 48 is connected to a suitable electrical outlet and power is being supplied to the device 10. A lamp power indicator 79 is also mounted on the shroud 70 and indicates when power is being supplied to the lamp 25. A first fuse 75 (2 amps) and a second fuse 76 (20 amps) may also be utilized in the electrical schematic of the device 10.

A volt meter 80 is utilized in the electrical schematic of the device 10. The volt meter 80 reads out the amount of voltage going to the light 25. Under normal circumstances, the voltage is anticipated to be 120 volts. The amount of curing is determined by the speed on which the device 10 is moved as well as by the amount of radiation given off by the light 25. The amount of radiation is dependent upon the voltage going to the light 25. It is anticipated that the voltage will always be 120 volts, for instance in the United States. As long as the voltage is close to this, the correct amount of curing takes place when the operator travels at the operator's normal speed. However, if the voltage goes below this number, the operator has to compensate by going at a lower speed. To date, the prior art devices have not had any way of determining whether or not the correct amount of voltage is being supplied to an electrical outlet. With the increases in brownouts and power shortages, this is a critical factor as the electrical companies will sometimes reduce the voltage available through their lines. The other reasons previously noted also give rise to the need addressed by the volt meter 80. The volt meter 80 reads the amount of voltage available to the lamp 25 and allows the operator to make the necessary compensation when curing the floor for the first time. The operator is not left with the situation of having done the whole floor at its given speed and then having to redo it when it is later determined that the floor is not curing due to lower voltage. While the preferred embodiment of the present invention uses a volt meter, it is understood the other suitable signaling devices such as a light may also be used. Further, while the present invention contemplates having the operator correct the voltage problem before proceeding, it is also possible to compensate for the difference in voltage by propelling the device at a different speed, it is understood that if the device 10 was powered by a motor, compensation could be made by controlling the speed of the motor.

The power supply from Fusion is a Fusion Aetek UV 120 volt, 20 amp power supply and the bulb is a lamp-Fusion Aetek UV 07-01548 18-inch bulb, although it is recognized that other suitable bulbs or housing and power supply may be utilized.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An apparatus for curing a photocurable material applied to a floor surface, comprising:

a) a wheeled frame;

b) a light housing releasably connected to the frame;

c) a power supply operatively connected to the frame;

d) a source of curing light mounted in the light housing;

e) a first connector operatively connected to the power supply;

f) a second, mating connector operatively connected to the source of curing light, wherein the first and second connectors are releasably connected to each other; and g) a releasable connection between the housing and the frame consisting essentially of one mechanical connection, the mechanical connection consisting essentially of:

i) a first mounting mechanism connected to the light housing; and ii) a second mounting mechanism connected to the frame and in mating connection to the first mounting mechanism, wherein the light housing is releasably connected to the frame.

2. The apparatus of claim 1, wherein the fast mounting mechanism is a first mounting member having a first member forming a first slot with a first plate operatively connected to the light housing and the second mounting mechanism is a second mounting member having a second member forming a second slot with a second plate operatively connected to the frame.

3. The apparatus of claim 2, wherein the first member is mounted at a first angle to the first plate and the second member is mounted to the second plate at a second angle to the second plate the first and second angles being equal.

4. The apparatus of claim 3, wherein the first mounting mechanism comprises a third mounting member, operatively connected to the first plate, the first and third mounting members forming a generally V-shape, and the second mounting member comprises a fourth mounting member operatively connected to the second plate, the second and third mounting members forming a generally V-shape.

5. An apparatus for curing a photocurable material applied to a floor surface, comprising:

a) a wheeled frame;

b) a light housing operatively connected to the frame;

c) a fixed output power supply;

d) a source of curing light mounted in the light housing; and e) the light housing having top and the top being a limiting factor in the apparatus going under an obstacle and the top having a maximum height of 7 inches from the floor, wherein the apparatus is transportable and easily maneuverable in areas with limited access.

6. The apparatus of claim 5, wherein the apparatus has a weight of 100 pounds or less.

7. An apparatus for curing a photocurable material applied to a floor surface, comprising:

a) a wheeled frame;

b) a light housing releasably connected to the frame;

c) a power supply operatively connected to the frame;

d) a source of curing light mounted in the light housing;

e) a first mounting mechanism operatively connected to the light housing;

f) a second mounting mechanism operatively connected to the frame, wherein the light housing is releasably connected to the frame.

g) one of the first and second mounting mechanism having first and second positions, whereby the light housing is connectable to the frame at first and second lateral positions.

8. The apparatus of claim 7, wherein the first mounting mechanism is a first mounting member having a first member forming a first slot with a first plate operatively connected to the light housing and the second mounting mechanism is a second mounting member having a second member forming a second slot with a second plate operatively connected to the frame, one of said housing and frame having a first support member and the other of said housing and frame having a second, receiving support member.

9. The apparatus of claim 8 wherein the first support member is a post and the second support member is an opening formed in the other of said housing and frame.

10. An apparatus for curing a photocurable material applied to a floor surface, comprising:

a) a wheeled frame;

b) a light housing operatively connected to the frame;

c) a power supply operatively connected to the frame;

d) a source of curing light mounted in the light housing; and e) the light housing sized and configured to extend, laterally, at least 1 inch from any other portion of the apparatus, wherein the apparatus is moveable parallel to and underneath an overhang.

11. The apparatus of claim 10, wherein the light housing extends at least 2 inches from any other portion of the apparatus.

12. The apparatus of claim 10, wherein the light housing extends at least 3 inches from any other portion of the apparatus.

13. The apparatus of claim 10, further comprising a volt meter operatively connected to the power supply, wherein voltage to the power supply may be measured.

14. An apparatus for curing a photocurable material applied to a floor surface, comprising:

a) a wheeled frame;

b) a light housing releasably connected to the frame;

c) a fixed output power supply;

d) a source of curing light mounted in the light housing;

e) a first connector operatively connected to the power supply;

f) a second, mating connector operatively connected to the source of curing light, wherein the first and second connectors are releasably connected to each other;

g) a releasable connection between the housing and the frame consisting essentially of:

i) a first mounting mechanism operatively connected to the light housing;

ii) a second mounting mechanism operatively connected to the frame, wherein the light housing is releasably connected to the frame and in mating connection to the first mounting mechanism;

h) the light housing having a height of 7 inches or less from the floor, and the apparatus having a weight of 100 pounds or less, wherein the apparatus is transportable and easily maneuverable in areas with limited access;

i) one of the first and second mounting mechanism having first and second positions whereby the light housing is connectable to the frame at first and second lateral positions; and j) the light housing sized and configured to extend, laterally, at least 1 inch from any other portion of the apparatus, wherein the apparatus is moveable parallel to and underneath an overhang.

15. The apparatus of claim 14, further comprising a volt meter operatively connected to the power supply, wherein voltage to the power supply may be measured.

* * * * *